United States Patent [19]

Roberts

[11] Patent Number: 4,596,387

[45] Date of Patent: Jun. 24, 1986

[54] EXERCISE HANDLES FOR ATHLETIC SHOES

[76] Inventor: Patrick S. Roberts, 300 Dorado Pl. SE., Apt. J-5, Albuquerque, N. Mex. 87123

[21] Appl. No.: 675,550

[22] Filed: Nov. 28, 1984

[51] Int. Cl.[4] ..... A63B 21/18

[52] U.S. Cl. ..... 272/93; 24/68 SK; 36/114; 128/25 B; 272/96; 272/116; 272/125; 272/143; 273/DIG. 18; 273/DIG. 30

[58] Field of Search ..... 272/93, 70, 70 A, 119, 272/125, 143, 145, 94, 96; 273/DIG. 18, DIG. 30; 434/247, 250, 260; 446/26; 24/68 SK; 36/113, 114, 117, 122, 125, 132, 136, 138, 8.3, 11, 23, 62, 66, 71.5; 128/25 B

[56] References Cited

U.S. PATENT DOCUMENTS

| | | | |
|---|---|---|---|
| 307,744 | 11/1884 | Buck | 36/11 X |
| 362,507 | 5/1887 | Hall | 36/11 |
| 914,780 | 3/1909 | Auer | 36/62 |
| 1,136,150 | 4/1915 | McGrath | 36/113 X |
| 1,995,975 | 3/1935 | Fleschutz | 36/62 |
| 1,997,139 | 4/1935 | Gardener et al. | 272/57 |
| 2,110,890 | 3/1938 | Paul | 36/113 X |
| 2,361,972 | 11/1944 | Smith | 36/62 |
| 2,467,943 | 4/1949 | Milkell, Jr. | 272/96 |
| 2,539,761 | 1/1951 | Whitman | 36/114 |
| 2,644,248 | 7/1953 | Seligman | 36/7.5 |
| 2,835,249 | 5/1958 | Brandano | 36/66 X |
| 4,444,389 | 4/1984 | Wrucke | 272/96 |

*Primary Examiner*—Robert A. Hafer
*Assistant Examiner*—Arnold W. Kramer
*Attorney, Agent, or Firm*—Walter R. Keller

[57] ABSTRACT

The invention comprises flexible handles which are adjustable in length, and which are attached to athletic shoes. The handles may be attached at various points on each shoe, adjusted to the desired length, and the wearer can grasp the handles to aid and augment exercises, and muscle toning routines.

12 Claims, 6 Drawing Figures

EXERCISE HANDLES FOR ATHLETIC SHOES

SUMMARY

A great many people regularly exercise, and the exercises quite often take the form of calisthentics or Jazzercise dance exercises. Many of the exercises require the person to touch or grasp the foot and flex the leg or legs, or the waist or back and arms while grasping or touching the feet or toes. For beginners, overweight people, or people who are recovering from injury, it is often very difficult or impossible to touch the toes or grasp the feet. Anyone whose muscles are stiff and tight can experience some degree of difficulty in performing the exercises which require touching or grasping the feet or toes. Thus it is very desireable to assist the exercising persons to secure a hold on the feet or toes to enable them to perform the exercises to the best of their ability. Almost without exception, persons who perform exercises wear some form of athletic shoes. While there are a myriad of different shoes commercially available, they basically resemble and were called tennis shoes or sneakers. While the shoes vary in construction, size and design, they all generally have a rubber, or rubber substitute, sole and lightweight uppers made of canvas or canvas substitute. It is therefore an objective of the invention to attach flexible and adjustable handles to athletic shoes so as to enable the beginner, injured, and otherwise less flexible persons to perform the popular exercises.

DESCRIPTION OF THE PRIOR ART

1. Field of the Invention

The invention relates generally to exercise devices, and more specifically to athletic shoes and foot worn exercise aids.

2. Description of the Prior Art

Exercise devices which attach to a persons feet are not new. Roller skates, ice skates, and skis have long used shoes to attach the basic exercise equipment to the feet. Special purpose equipment such as the tendon stretching device of WRUCKE, U.S. Pat. No.4,444,389, attaches to a persons foot, as do the exercise devices of GARDENER, U.S. Pat. No. 1,997,139 and OGDEN, U.S. Pat. No. 2,069,384. Several toys also affix to the foot such as the common stilt and the walking horse toy ot SELIGMAN, U.S. Pat. No. 2,644,248. However, in each of the above cases the special device either replaced the shoe or was designed for the shoe to be inserted therein. Only the toy of Seligman had straps which were grasped by the wearer's hand and the straps were to enable the wearer to secure the toy to the wearer's feet. The strap on the toy did not affix to the wearer's shoes.

DESCRIPTION OF THE PREFERRED EMBODIMENT

Figure 1:
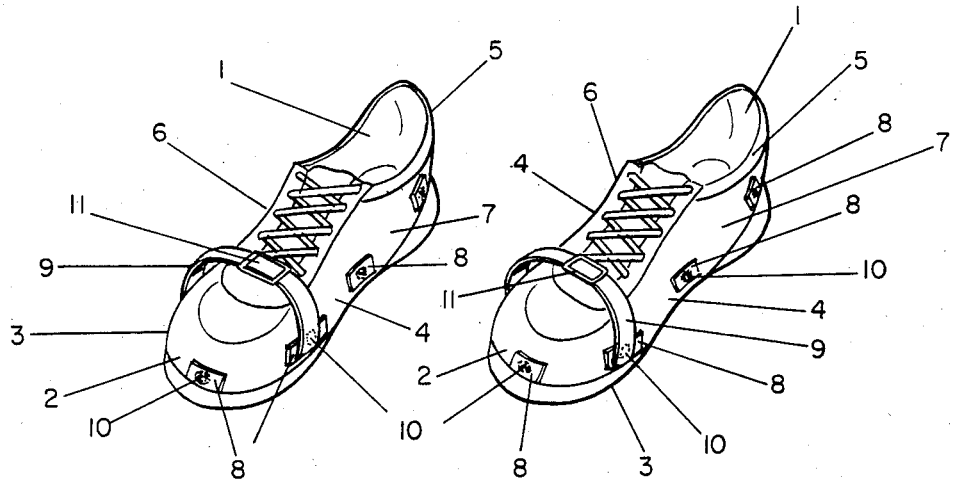
FIG. 1 is an isometric view of the invention.

FIG. 1 shows a pair of athletic shoes 1, which are basically of the tennis or sneaker type. The shoes 1 have the general areas shown as the toe area 2, the ball area 3, the arch area 4, the heel area 5, and each shoe 1 has a right side 6, and a left side 7. FIG. 1 also shows the fundamentals of the invention which are a plurality of attaching means 8 on each shoe 1, a handle 9 for each shoe 1, each said handle 9 having mating means 10 on each extremity thereof, and each said handle 9 having, approximately at its mid-length, an adjusting means 11. As shown in FIG. 1, the attaching means 8 are more or less permanently affixed to the shoe 1, and the mating means 10 are more or less permanently affixed to the handle 9. The configuration shown in FIG. 1 is designated the toe loop handle. In the toe loop handle configuration, the attaching means 8 are affixed to the shoe 1 adjacent to the ball area 3 of each shoe 1, one on the left side 7 and one on the right side 6, of each shoe 1. Each handle 9 has a mating means 10 affixed to each extremity of the handle 9, and has an adjustable means 11 at the approximate mid-length of the handle 9. One handle 9 is affixed to each shoe 1 by affixing one mating means 10 to the attaching means 8 on the right side 6 of the shoe 1, and the other mating means 10 being affixed to the attaching means 8 on the left side 7 of the same shoe 1. Thus attached, each handle 9 is formed into a loop type handle across the toe area 2, since the handle 9 is made of flexible material such as webbing, or cordage. The size of the loop can be adjusted by the adjusting means 11 to accomodate the wearer's flexibility and size, and to accomodate the reach of the wearer. The adjusting means 11 is shown to be a slide type buckle but may be of any commonly known type, even including simply tying a knot. To accomodate other configurations, attaching means 8 are also placed on the right side 6 and the left side 7 of each shoe 1 at the arch area 4, the heel area 5, as well as the ball area 3 as shown, and one attaching means 8 is affixed to each toe 2 of each shoe 1. The mating means 10 on each end of each handle 9 may be attached to any of the attaching means 8 on either shoe 1. Thus there are a multiplicity of possible combinations of loops type handles 9 that can be formed with only two handles 9. It is also to be noticed that the mating means 10 on a handle 9 can be connected to the other mating means 10 on the same handle 9 or with a mating means 10 on another handle 9. Thus, for example, one mating means 10 from one handle 9 may be affixed to the single toe 2 attaching means 8 on one shoe 1, and another mating means 10 on another handle 9 may be attached to the single attaching means 8 at the toe 2 of the other shoe 1, and the two free mating means 10, one on each extremity of each handle 9, may be affixed to each other forming a long loop, of the two handles 9, between the two toes 2 of the shoes 1 of the wearer.

Figure 2:
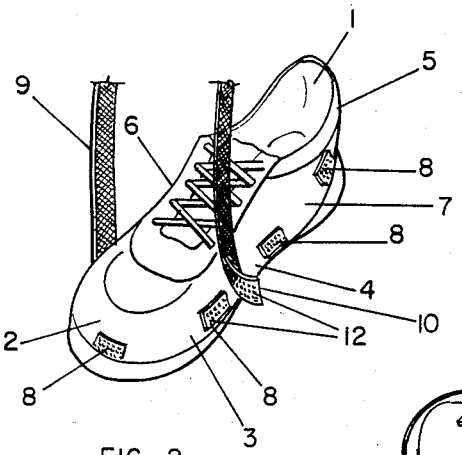
FIG. 2 is an isometric view of the attachment means and the mating means being Velcro.
Figure 3:
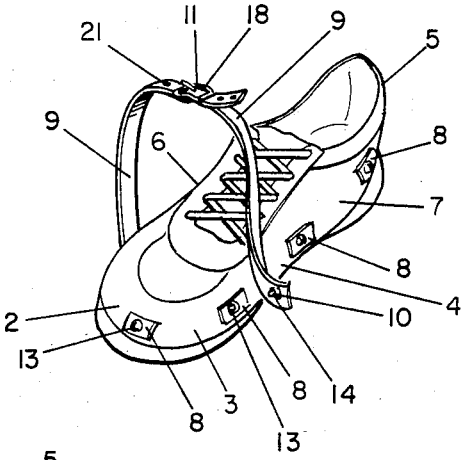
FIG. 3 is an isometric view of the attachment means and the mating means as snaps.

The attaching means 8 may have several configurations. Shown in FIG. 2 is an attaching means being made of Velcro 12 material. In this configuration, a small patch of Velcro 12 material would be sewn to the shoe 1 at the various areas aforementioned. This configuration reguires that the mating means 10 on each end of the handles 9 also be made of Velcro 12 material affixed to the ends of the handles 9. FIG. 3 shows the attaching means 8 to be a snap 13 affixed to the shoe 1 at the aforementioned areas, and the mating means 10 affixed to the ends of the handle 9 to be a mating snap 14. Functionally it is immaterial whether the attaching means 8 is a male snap or a female snap, as long as the mating means 10 is the opposite of the attaching means 8 in this configuration.

Figure 4:
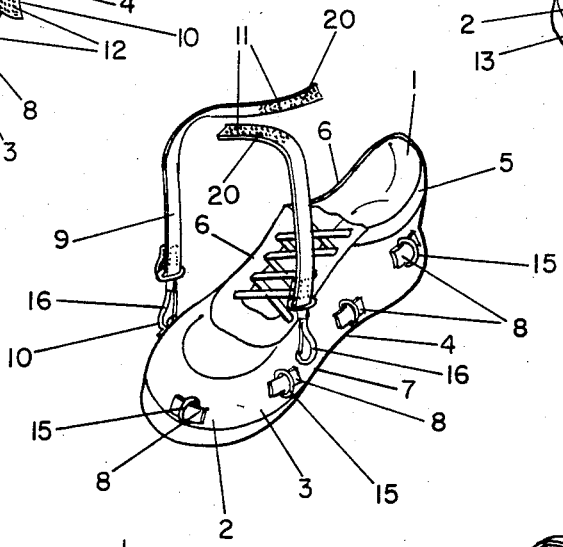
FIG. 4 is an isometric view of the attachment means being rings and the mating means being clips.
Figure 5:
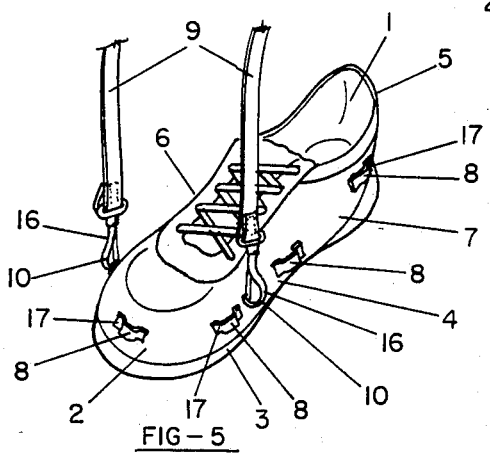
FIG. 5 is an isometric view of the attachment means being essentially horizontal loops and the mating means being clips.
Figure 6:
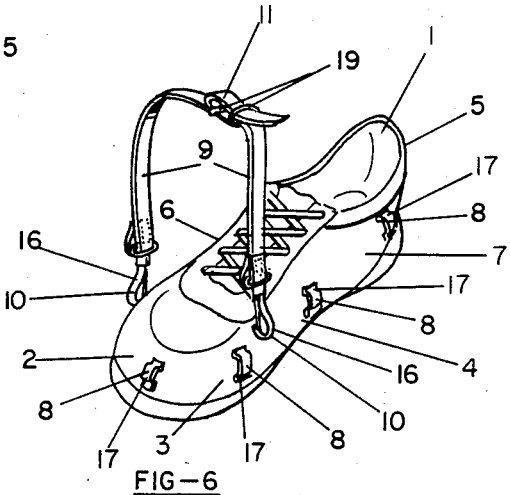
FIG. 6 is an isometric view of the attachment means being essentially vertical loops and the maing means being clips.

FIG. 4 shows the attaching means 8 to be a small ring 15, affixed as by sewing, to the shoe 1 at the various aforementioned areas. The mating means is shown to be a clip 16 or hasp which can engage securely the ring 15. In the simplest configuration, the attaching means 8 is merely a loop 17, similar to a belt loop, of material sewn to the shoe 1 at the aforementioned areas. The loop 17 may be made of any rather strong material such as canvas, rope, nylon, or even metal, and may be essentially horizontal as shown in FIG. 5, or vertical as shown in FIG. 6. The mating means 10 may be any configuration which will easily affix to the loop 17 such as a clip 16, or can even be tied as a shoe string, or a tab which passes through the loop 17 and affixes to itself, not shown.

The adjusting means 11 on a handle 9 may be any convenient method of adjusting, such as a buckle 18, or a pair of rings 19, or a series of snaps, or again Velcro material can be applied to the halves of the handle 9 to permit the handle 9 to be separated and reattached at its desired length.

I claim:

1. Exercise handles and a pair of athletic shoes, said handles comprising:

two handles, and a plurality of attachment means, each said attachment means being affixed separatedly and permanently at one of various positions on each shoe of the pair, and each handle being flexible, and having an adjusting means located at the approximate mid-length of the said handle to allow the length of the said handle to be lengthened or shortened, and each said handle having affixed thereto on each extremity, a mating means, whereby each of the said handles may be removably affixed to one of the shoes by mating the mating means to one of the attaching means on one of the shoes and the other mating means of said handle to another attaching means on said shoe, thereby forming a loop type handle on one shoe, and wherein the other handle is attached to the other shoe of the pair in an identical manner, thereby forming a loop type handle on the other shoe of the pair, and wherein both shoes of the pair have an adjustable loop type handle affixed to each shoe.

2. The exercise handles and athletic shoes of claim 1 wherein the attachment means are affixed to each shoe of the pair externally on the left and right sides in the ball area, the arch area, and the heel area, and one attachment means is affixed to the toe area of each shoe.

3. The exercise handles and athletic shoes of claim 1 wherein the mating means are affixed to the extremities of the handles, and wherein any of the maing means can mate with anyone of the attaching means on each of the shoes of the pair.

4. The exercise handles and athletic shoes of claim 1 wherein the attachment means are patches of Velcro material sewn to each shoe of the pair, said patches being sewn to each shoe, externally on the left side and the right side at the ball area, the arch area, and the heel area, and one patch is sewn to the toe area of each said shoe, and wherein the mating means, affixed to the extremities of each handle, are Velcro material.

5. The exercise handles and athletic shoes of claim 1 wherein the attachment means are snaps affixed externally to each shoe of the pair, said snaps being affixed externally on the left side and the right side at the ball area, the arch area, and the heel area, and one snap at the toe area of each shoe, and wherein the mating means is a mating snap affixed to the extremities of the handles, and wherein all attachment means are of one gender, male or female, and wherein the mating means are all of one gender, male or female, and wherein the mating means are all of the opposite gender from the attachment means, male or female.

6. The exercise handles and athletic shoes of claim 1 wherein the attachment means are loops of rather strong material, similar to belt loops, and wherein the loops are sewn to each shoe of the pair externally on the left side and the right side at the ball area, the arch area, and the heel area, and wherein one loop is sewn at the toe area of each shoe of the pair, and wherein the mating means is a clip type means capable of being easily secured and removed from the loops.

7. The exercise handles and athletic shoes of claim 1 wherein the attachment means are rings, made of metal, which are affixed to each shoe of the pair externally on the left side and the right side at the ball area, the arch area, and the heel area, and one ring is affixed to the toe area of each shoe of the pair, and wherein the mating means at the extremities of the handles are clips which can be easily secured to and removed from the rings.

8. The exercise handles and athletic shoes of claim 1 wherein the adjusting means is a buckle and holes to accomodate the buckle.

9. The exercise handles and athletic shoes of claim 1 wherein the adjusting means is two rings affixed to one half handle of each handle, and through which the other half handle is threaded so that the second half handle folds on itself, securing the two half handles to each other.

10. The exercise handles and athletic shoes of claim 1 wherein the handles are made out of cordage.

11. The exercise handles and athletic shoes of claim 1 wherein the handles are made out of webbing material.

12. The exercise handles and athletic shoes of claim 1 wherein the handles are made out of flexible leather.

* * * * *